US007610789B1

(12) United States Patent
Liu et al.

(10) Patent No.: US 7,610,789 B1
(45) Date of Patent: Nov. 3, 2009

(54) CURLING DIE TOOL

(75) Inventors: Yi-Hua Liu, Shenzhen (CN); Fu-Shun Huang, Taipei Hsien (TW); Chia-Hsiang Ou, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/238,410

(22) Filed: Sep. 25, 2008

(30) Foreign Application Priority Data

Apr. 18, 2008 (CN) ..... 2008 1 0301196

(51) Int. Cl.
*B21D 5/01* (2006.01)

(52) U.S. Cl. ..... 72/384; 72/379.2; 72/404; 72/466.9; 72/472

(58) Field of Classification Search ..... 72/379, 72/381, 384, 389.1, 389.3, 389.6, 404, 472, 72/477, 466.9
See application file for complete search history.

(56) References Cited

U.S. PATENT DOCUMENTS 846,139 A * 3/1907 Pruden ..... 72/379.2
3,301,035 A * 1/1967 Gill ..... 72/404
4,852,379 A * 8/1989 Levenberg ..... 72/384
6,269,672 B1 * 8/2001 Schutz ..... 72/379.2

OTHER PUBLICATIONS

Power Brakes Dies, Inc. "General Purpose and SPecial Press Brake Tooling", 1974, Catalog 480, Curling Dies.*
The Cincinnati Shaper Company, "Cincinnati Mechanical Press Brakes", Dec. 1959, Catalog B-12, p. 37.*

* cited by examiner

*Primary Examiner*—David B Jones
(74) *Attorney, Agent, or Firm*—Frank J. Niranjan

(57) ABSTRACT

A curling die tool includes an upper die, a transmission, and a lower die. The upper die includes an upper-die body and a warping-bending pressure portion for a workpiece. The warping-bending pressure portion includes a punch member and is secured to the upper-die body. The transmission member includes a first supporting body corresponding to the punch member supporting the workpiece, along with a curling pressure portion. The transmission member defines a first supporting groove facing the upper die receiving the first supporting body, along with a curling-pressure-portion receiving groove opposite to the first supporting groove receiving the curling pressure portion. The lower die includes a second supporting body facing the curling pressure portion, supporting the workpiece, and defining a guiding groove and a second supporting groove receiving the second supporting body. The transmission member is movably connected to the lower die and slides along the guiding groove.

13 Claims, 4 Drawing Sheets

CURLING DIE TOOL

BACKGROUND

1. Field of the Invention

The disclosure relates to molding technology and, particularly, to a curling die tool to form a cylindrical curled edge of a workpiece.

2. Description of the Related Art

Generally, three die sets are required to form a curled edge on a workpiece in three sequential steps. First, the first die set warps an edge of the workpiece to a particular degree. In the second step, the second die set bends a portion of the workpiece adjacent to the warped edge. In the third step, the third die set curls the warped edge and the bent portion of the workpiece to form the curled edge. However, because it is necessary to adjust the three die sets before feeding the workpiece, the process is inefficient.

Therefore, what is needed is a curling die tool which can overcome the described limitations.

DETAILED DESCRIPTION

Figure 1:
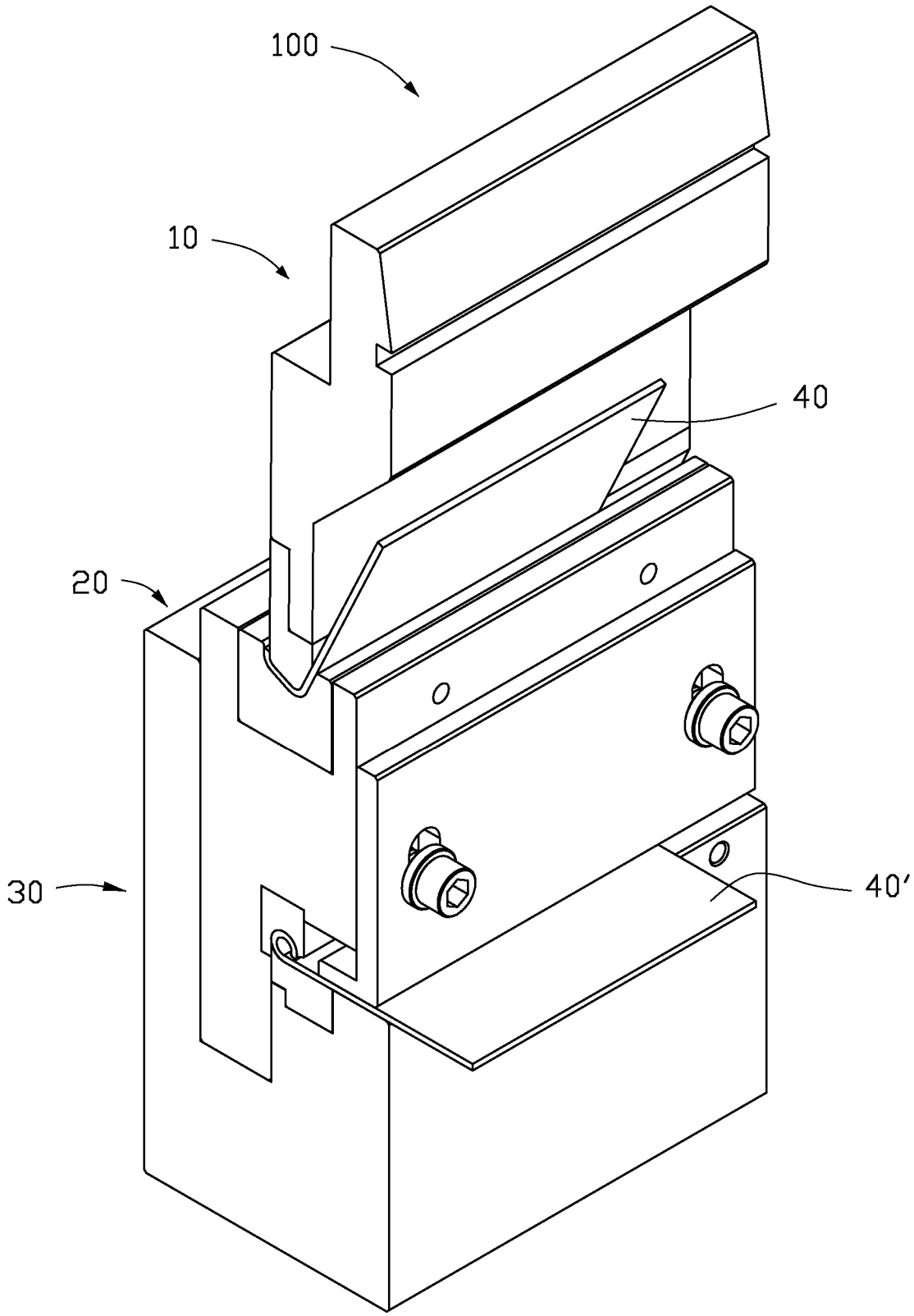
FIG. 1 is an isometric view of a curling die tool, according to an exemplary embodiment.

Referring to FIG. 1, a curling die tool 100 used to form a curled edge of a workpiece 40, 40', according to an exemplary embodiment, includes an upper die 10, a transmission member 20, and a lower die 30. The transmission member 20 is movably connected to the lower die 30.

Figure 2:
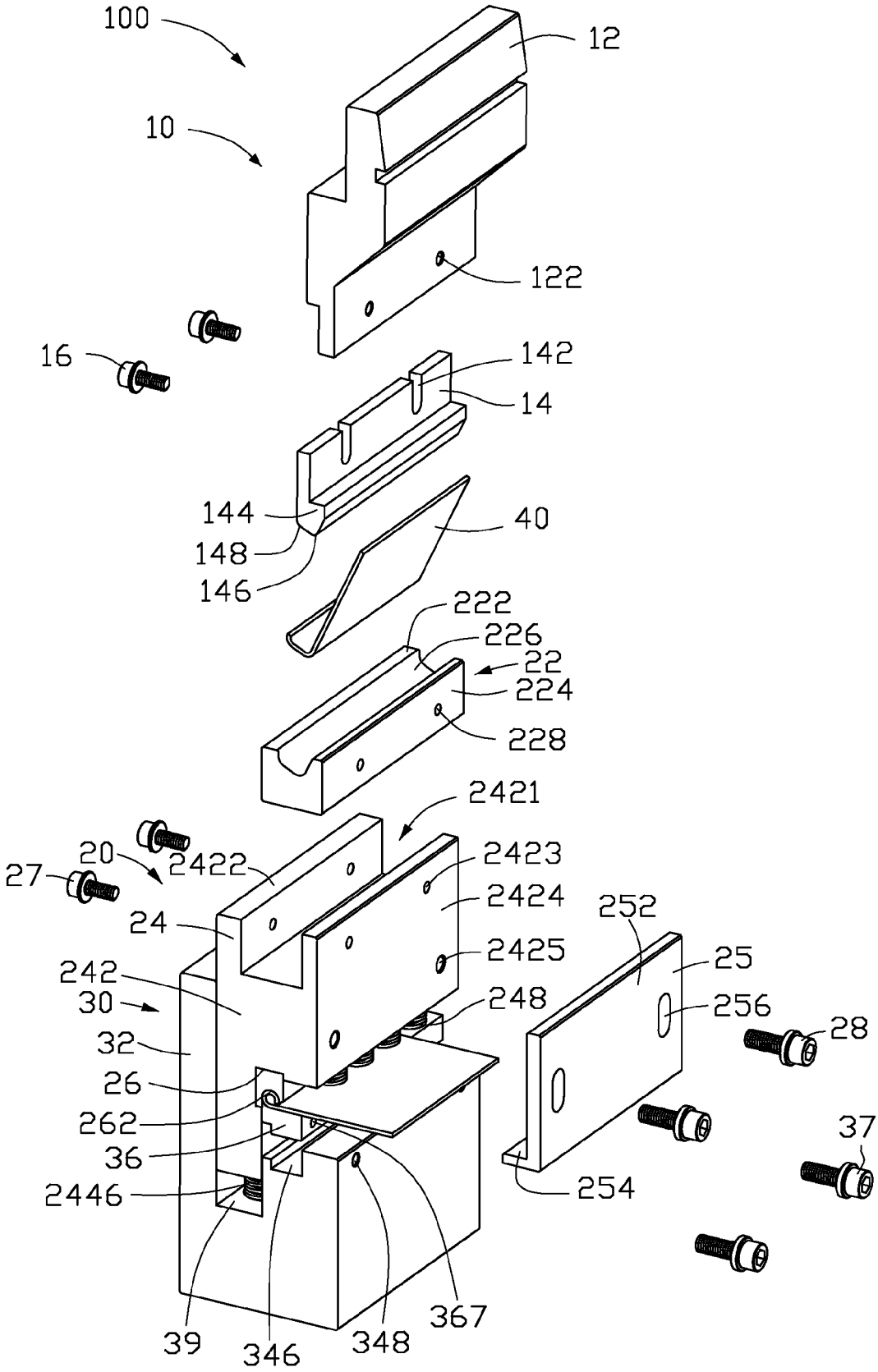
FIG. 2 is an exploded, isometric view of the curling die tool of FIG. 1.

Referring to FIG. 2, the upper die 10 includes an upper-die body 12, a warping-bending pressure portion 14, and two first screws 16. The upper-die body 12 defines two first screw holes 122 in an end close to the transmission member 20, according to the two first screws 16, respectively. Two U-shaped cutouts 142 are defined in one end of the warping-bending pressure portion 14, corresponding to the two first screw holes 122. The warping-bending pressure portion 14 includes a punch member 144 extending from the other end thereof. The punch member 144 includes a V-shaped bending portion 146 and a warping portion 148 seamlessly connected to the bending portion 146. The first screws 16 pass through the corresponding U-shaped cutouts 142 and respectively engage the first screw holes 122 so that the warping-bending pressure portion 14 is secured to the upper-die body 12. Alternatively, the warping-bending pressure portion 14 may be integrally formed with the upper-die body 12. In other embodiments, the warping-bending pressure portion 14 may be secured to the upper-die body 12 by glue or a welding joint.

Figure 3:
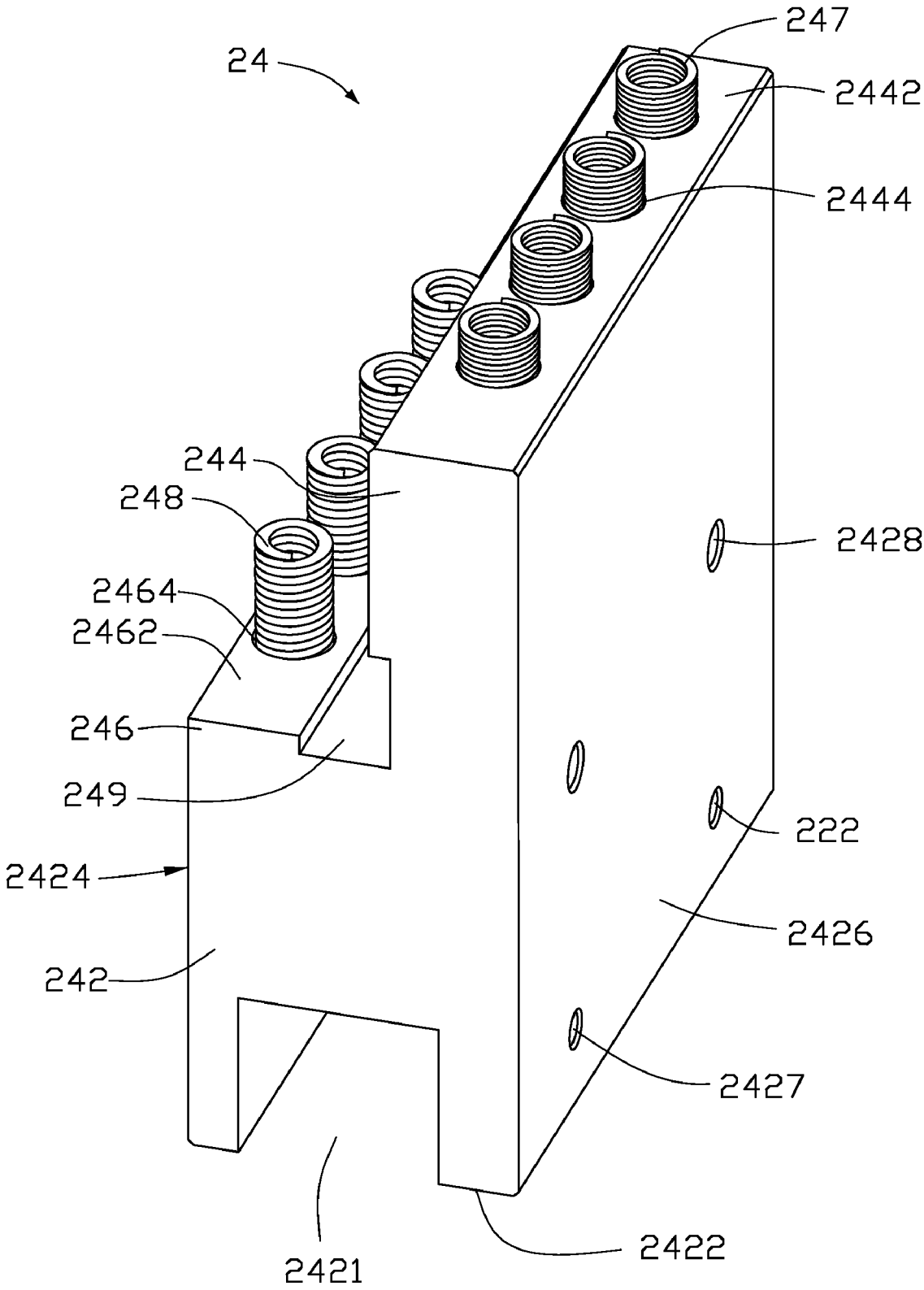
FIG. 3 is an isometric view of an inverted transmission body of the curling die tool of FIG. 1.

Referring to FIGS. 2-3, the transmission member 20 includes a first supporting body 22, an inverted H-shaped transmission body 24, an L-shaped flattening pressure portion 25, a curling pressure portion 26, two second screws 27, and two third screws 28.

The first supporting body 22 supports the workpiece 40 thereon. The first supporting body 22 includes a first top surface 222 and two first side surfaces 224. A workpiece receiving groove 226 is defined on the first top surface 222 and is shaped to match the punch member 144. The workpiece receiving groove 226 receives the workpiece 40 for warping and bending by the punch member 144. Two through holes 228 are defined through the two first side surfaces 224 of the first supporting body 22.

The transmission body 24 includes a main body 242, a guiding portion 244, an elongated protrusion 246, four first elastic elements 247, and four second elastic elements 248.

The main body 242 includes a second top surface 2422 facing the upper die 10, along with two opposite second side surfaces 2424, 2426. A first supporting groove 2421 is defined on the second top surface 2422, and receives the first supporting body 22. Two second screw holes 2423 and two fourth screw holes 2427 are respectively defined on the second side surfaces 2424 and 2426 symmetrically adjacent to the upper die 10 corresponding to the two through holes 228 of the first supporting body 22 respectively. The second and fourth screw holes 2423, 2427 connect with the first supporting groove 2421. Two third and two fifth screw holes 2425 and 2428 are symmetrically defined on the second side surfaces 2424 and 2426 away from the upper die 10, respectively. Each second screw 27 passes through a corresponding fourth screw hole 2427, a corresponding through hole 228, and engages the second screw hole 2423 so that the first supporting body 22 is secured to the transmission body 24. Alternatively, the first supporting body 22 may be integrally formed with the transmission body 24. In other embodiments, the first supporting body 22 may be secured to the transmission body 24 by a welding joint or interference fit.

The guiding portion 244 protrudes from the main body 242 away from the second top surface 2422, and includes a first surface 2442 opposite to the second top surface 2422. Four first blind holes 2444 are defined on the first surface 2442. The first elastic elements 247 are compression springs. One end of each first elastic element 247 is received in a corresponding first blind hole 2444, while the other end extends out of the corresponding first blind hole 2444.

The protrusion 246 protrudes from the main body 242 away from the second top surface 2422 and is spaced from the guiding portion 244. The protrusion 246 includes a second surface 2462 opposite to the second top surface 2422. Four second blind holes 2464 are defined on the second surface 2462. The second elastic elements 248 are compression springs. One end of each second elastic element 248 is received in a corresponding second blind hole 2464, while the other end extends out of the corresponding second blind hole 2464.

The flattening pressure portion 25 includes a connecting portion 252 and a depressing portion 254 perpendicularly extending from the connecting portion 252. Two first waist-shaped holes 256 are defined through the connecting portion 252, and aligned with the third screw holes 2425. Each third screw 28 passes through the corresponding first waist-shaped hole 256, and engages the third screw hole 2425 so that the flattening pressure portion 25 is secured to the transmission body 24. The depressing portion 254 faces the second surface 2462 and contacts the end of the second elastic elements 248 extending out of the second blind holes 2464.

The guiding portion 244, the protrusion 246, and the main body 242 collectively define a curling-pressure-portion receiving groove 249 firmly receiving the curling pressure portion 26. The curling pressure portion 26 defines an annular shaped groove 262 away from the second top surface 2422 of the main body 242 to perform the curling operation. The curling pressure portion 26 may be integrally formed with the transmission body 24. In other embodiments, the curling pressure portion 26 may be secured to the transmission body 24 by glue or a screw joint.

Figure 4:
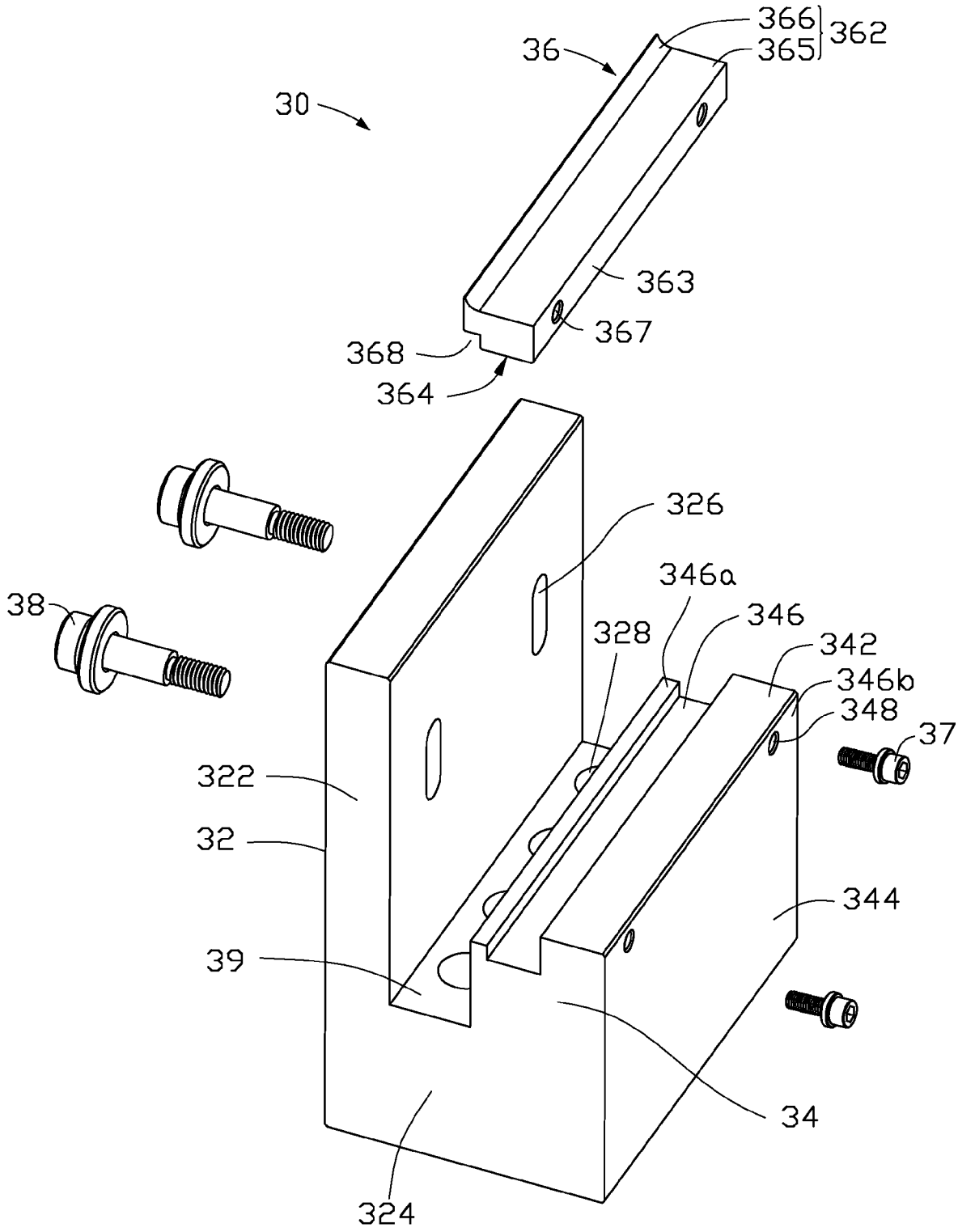
FIG. 4 is an isometric view of a lower die of the curling die tool of FIG. 1.

Referring to FIGS. 2-4, the lower die 30 includes an L-shaped lower-die body 32, a supporting portion 34, a second supporting body 36, two fourth screws 37, and two fifth screws 38.

The lower-die body 32 includes a guiding plate 322 and a body portion 324, perpendicularly extending from the guiding plate 322. Two second waist-shaped holes 326 are defined through the guiding plate 322 corresponding to the fifth screw holes 2428.

The supporting portion 34 extends perpendicularly from the body portion 324, and includes a third top surface 342 and a third side surface 344 perpendicularly connected to the third top surface 342. A second supporting groove 346 is defined on the third top surface 342 to receive the second supporting body 36. One sidewall 346*a* is lower than the other sidewall 346*b* of the supporting groove 346. Two sixth screw holes 348 are defined on the third side surface 344 of the supporting portion 34.

The second supporting body 36 includes a fourth top surface 362, a fourth side surface 363 perpendicularly connected to the fourth top surface 362, and a bottom surface 364 facing the second supporting groove 346. The fourth top surface 362 is substantially coplanar with the third top surface 342 when the second supporting body 36 is received in the second supporting groove 346. The fourth top surface 362 includes a flattening portion 365 and a curved portion 366 seamlessly connected thereto. Two seventh screw holes 367 are defined on the fourth side surface 363 corresponding to the sixth screw holes 348. Each fourth screw 37 passes through the corresponding sixth screw hole 348, and engages the seventh screw holes 367 so that the second supporting body 36 is secured to the supporting portion 34. Alternatively, the second supporting body 36 may be integrally formed with the supporting portion 34. In other embodiments, the second supporting body 36 may be secured to the supporting portion 34 by a welding joint or an interference fit. An L-shaped cutout 368 is defined on the bottom surface 364 to match the sidewall 346*a* of the second supporting groove 346 when the second supporting body 36 is received in the second supporting groove 346.

Parallel supporting portion 34 and guiding plate 322 are spaced from each other and collectively define a guiding groove 39 receiving the guiding portion 244 of the transmission body 24. The bottom of the guiding groove 39 defines four third blind holes 328 corresponding to the first blind holes 2444 of the guiding portion 244. The transmission member 20 is movably connected to the guiding plate 322 via the fifth screws 38 extending through the second waist-shaped holes 326 and the fifth screw holes 2428 of the second side surfaces 2426. Therefore, the transmission member 20 can slide reciprocally within the guiding groove 39.

The first elastic elements 247 is not limited by this embodiment, and the first elastic elements 247 may be respectively fixed in the third blind holes 328. The second blind holes 2464 are not limited by this embodiment, and the second blind holes 2464 may be defined in the depressing portion 254.

Referring to the FIGS. 1-4, a two-step operation is required to form a curled edge of the workpiece 40 using the curling die tool 100. First, the workpiece 40 is placed on the first supporting body 22. When the upper-die body 12 moves downward by application of an outer force, the warping-bending pressure portion 14 depresses the workpiece 40 along with the motion of the upper-die body 12. Therefore, when the punch member 144 matches the workpiece receiving groove 226, the workpiece 40 is warped and bent by combined force from the bending portion 146 and the warping portion 148 of the punch member 144 and the workpiece receiving groove 226. Secondly, the workpiece 40', after having been warped and bent, is placed on the second supporting body 36. When the upper-die body 12 moves downward by application of outer force again, the transmission member 20 slides downward along the guiding groove 39. Meanwhile the depressing portion 254 of the flattening pressure portion 25 flattens the workpiece 40' on the flattening portion 365 of the fourth top surface 362 and the third top surface 342. Additionally, the curved portion 366 is connected with the n-shaped groove 262. Therefore, a curled edge of the workpiece 40' is formed by combined force from the curling pressure portion 26 and the second supporting body 36. When the outer force is released, the transmission member 20 slides upwardly along the guiding groove 39 by elastic action on the guiding portion 244 by the first elastic elements 247 and on the protrusion 246 by the second elastic elements 248. As a result, the workpiece 40', having been curled, can be taken up. Efficiency in formation of the curled edge of the workpiece 40, 40' is thus enhanced.

It is to be understood, however, that even though numerous characteristics and advantages of the present embodiments have been set fourth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A curling die tool used to form a curled edge of a workpiece, the curling die tool comprising:

an upper die comprising an upper-die body and a warping-bending pressure portion capable of warping and bending the workpiece, the warping-bending pressure portion comprising a punch member and being secured to the upper-die body;

a transmission member comprising a first supporting body corresponding to the punch member of the warping-bending pressure portion, for supporting the workpiece, and a curling pressure portion for curling the workpiece, and defining a first supporting groove facing the upper die, for receiving the first supporting body, and a curling-pressure-portion receiving groove opposite to the first supporting groove, for receiving the curling pressure portion;

a lower die comprising a second supporting body facing the curling pressure portion, for supporting the workpiece, and defining a guiding groove and a second supporting groove receiving the second supporting body;

wherein the transmission member is movably connected to the lower die and slides reciprocally within the guiding groove;

wherein the transmission member comprises an H-shaped transmission body, the transmission body comprises a main body, a guiding portion and an elongated protrusion the main body comprises a second top surface on which the first supporting groove is defined, the guiding portion protrudes from the main body, the protrusion protrudes from the main body, and the guiding portion, the protrusion and the main body collectively form the curling-pressure-portion receiving groove firmly receiving the curling pressure portion.

2. The curling die tool as claimed in claim 1, wherein the warping-bending pressure portion is integrally formed with the upper-die body.

3. The curling die tool as claimed in claim 1, wherein the warping-bending pressure portion is secured to the upper-die body by glue or a welding joint.

4. The curling die tool as claimed in claim 1, wherein the punch member is a protrusion and comprises a V-shaped bending portion and a warping portion seamlessly connected to the bending portion, the first supporting body comprises a first top surface, and a workpiece receiving groove is defined on the first top surface, shaped to match the punch member.

5. The curling die tool as claimed in claim 1, wherein the first supporting body is received firmly in the first supporting groove by welding joint or screw joint and interference fit.

6. The curling die tool as claimed in claim 1, wherein the curling pressure portion defines an annular shaped groove.

7. The curling die tool as claimed in claim 1, wherein the transmission member comprises an L-shaped flattening pressure portion, the flattening pressure portion includes a connecting portion and a depressing portion extending perpendicularly from the connecting portion, the flattening pressure portion is secured to the main body, and the depressing portion faces the protrusion.

8. The curling die tool as claimed in claim 1, wherein the transmission member further comprises at least one first elastic element, the guiding portion comprises a first surface opposite to the second top surface, at least one first blind hole is defined on the first surface, and the at least one first elastic element is respectively fixed in the at least one first blind hole.

9. The curling die tool as claimed in claim 1, wherein the transmission member further comprises at least one second elastic element, the protrusion comprises a second surface opposite to the second top surface, at least one second blind hole is defined on the second surface, and the at least one second elastic element is respectively fixed in the at least one second blind hole.

10. The curling die tool as claimed in claim 1, wherein the lower die comprises an L-shaped lower-die body including a guiding plate and a body portion and a supporting portion extending from the body portion, wherein the supporting portion and the guiding plate are spaced from each other and collectively define the guiding groove, and the transmission member is movably connected to the guiding plate.

11. The curling die tool as claimed in claim 10, wherein the supporting portion comprises a third top surface, on which the second supporting groove is defined, and the second supporting body is firmly received in the second supporting groove by welding joint or screw joint or interference fit.

12. The curling die tool as claimed in claim 10, wherein at least one third blind hole is defined in a bottom of the guiding groove, corresponding to the first blind hole.

13. The curling die tool as claimed in claim 10, wherein the second supporting body includes a fourth top surface, and a bottom surface facing the second supporting groove, the fourth top surface is substantially coplanar with the third top surface when the second supporting body is received in the second supporting groove, a flattening portion and a curved portion are formed on the fourth top surface and seamlessly connect to each other, and an L-shaped cutout is defined on the bottom surface to match one sidewall of the fourth side surface when the second supporting body is received in the second supporting groove.

* * * * *